US011700481B2

(12) United States Patent
Ye

(10) Patent No.: US 11,700,481 B2
(45) Date of Patent: Jul. 11, 2023

(54) VARIABLE-DIRECTIVITY MEMS MICROPHONE AND ELECTRONIC DEVICE

(71) Applicants: ZILLTEK TECHNOLOGY (SHANGHAI) CORP., Shanghai (CN); ZILLTEK TECHNOLOGY CORP.

(72) Inventor: Jinghua Ye, Shanghai (CN)

( * ) Notice: Subject to any disclaimer, the term of this patent is extended or adjusted under 35 U.S.C. 154(b) by 0 days.

(21) Appl. No.: 17/665,017

(22) Filed: Feb. 4, 2022

(65) Prior Publication Data

US 2023/0035242 A1 Feb. 2, 2023

(30) Foreign Application Priority Data

Aug. 2, 2021 (CN) ..... 202110883196.3

(51) Int. Cl.
*H04R 1/32* (2006.01)
*H04R 3/00* (2006.01)

(52) U.S. Cl.
CPC ..... *H04R 1/326* (2013.01); *H04R 3/00* (2013.01); *H04R 2201/003* (2013.01)

(58) Field of Classification Search
None
See application file for complete search history.

(56) References Cited

U.S. PATENT DOCUMENTS

| | | | | |
|---|---|---|---|---|
| 11,284,187 | B1 * | 3/2022 | Huang | H04R 19/005 |
| 2010/0226507 | A1 * | 9/2010 | Horibe | H04R 3/005 381/92 |
| 2012/0328142 | A1 * | 12/2012 | Horibe | H04R 3/005 381/355 |
| 2017/0013355 | A1 * | 1/2017 | Kim | H04R 19/005 |
| 2021/0058702 | A1 * | 2/2021 | Shumard | H04R 19/04 |

* cited by examiner

*Primary Examiner* — Kenny H Truong
(74) *Attorney, Agent, or Firm* — Clement Cheng

(57) ABSTRACT

The invention relates to a variable-directivity MEMS microphone. The microphone comprises an acoustic cavity. The following components are provided inside the acoustic cavity: a first acoustic transducer for detecting an acoustic signal and converting the acoustic signal into a first acoustic conversion signal; a first pre-amplifier, connected to the first acoustic transducer, and configured for outputting a first electric signal; a second acoustic transducer for detecting an acoustic signal and converting the acoustic signal into a second acoustic conversion signal; a second pre-amplifier, connected to the second acoustic transducer, and configured for outputting a second electric signal; and a signal processing chip, connected to the first pre-amplifier and the second pre-amplifier, and configured for generating a directional output signal by performing an arithmetic operation on the first electric signal and the second electric signal under the action of a switching control signal.

8 Claims, 3 Drawing Sheets

VARIABLE-DIRECTIVITY MEMS MICROPHONE AND ELECTRONIC DEVICE

BACKGROUND OF THE INVENTION

1. Field of the Invention

The invention relates to the field of Micro-Electro-Mechanical systems, and more particularly, to a variable-directivity MEMS microphone.

2. Description of the Related Art

A MEMS (Micro Electro Mechanical System) microphone can be split into two types, namely, an omnidirectional microphone and a unidirectional microphone. In some directivity applications, the unidirectional microphone picks up sound from a specific direction, and it is sufficient for use. However, in more applications, the directivity of the microphone is required to be varied. In the prior art, a plurality of microphones are provided for achieving the switching of directivity. As a result, costs for devices and volume of an electronic device are increased.

SUMMARY OF THE INVENTION

Given that the foregoing problems exist in the prior art, the present invention provides a variable-directivity MEMS microphone which is capable of providing an output signal of different directivities.

A variable-directivity MEMS microphone, comprising an acoustic cavity, wherein the following components are provided inside the acoustic cavity:

a first acoustic transducer for detecting an acoustic signal and converting the acoustic signal into a first acoustic conversion signal;

a first pre-amplifier connected to the first acoustic transducer, and configured for outputting a first electric signal;

a second acoustic transducer for detecting an acoustic signal and converting the detection acoustic signal into a second acoustic conversion signal;

a second pre-amplifier connected to the second acoustic transducer, and configured for outputting a second electric signal; and a signal processing chip, connected to the first pre-amplifier and the second pre-amplifier, and configured for generating a directional output signal by performing an arithmetic operation on the first electric signal and the second electric signal under the action of a switching control signal.

In the variable-directivity MEMS microphone of the present invention, wherein the signal processing chip comprises:

a phase delayer, an output end of which is connected to the second electric signal, and the second electric signal is delayed by a predetermined phase based on the control signal, then a phase-delayed second electric signal is output;

an adder-subtractor for outputting the directional output signal after performing addition and subtraction operations on the first electric signal and the phase-delayed second electric signal.

In the variable-directivity MEMS microphone of the present invention, the phase delayer comprises:

an operational amplifier having a non-inverting input terminal and an inverting input terminal, an output terminal of the operational amplifier outputs the phase-delayed second electric signal;

a first resistor and a second resistor connected in series between the input end of the phase delayer and the non-inverting input terminal;

a first capacitor connected between the non-inverting input terminal and the ground;

a second capacitor, wherein one end of the second capacitor is connected at a joint where the first resistor and the second resistor are connected, the other end of the second capacitor is connected to the output terminal of the operational amplifier;

a third resistor connected between the inverting input terminal and the ground;

a fourth resistor connected between the inverting input terminal and the output end.

In the variable-directivity MEMS microphone of the present invention, the adder-subtractor performs an addition operation or a subtraction operation on the first electric signal or the phase-delayed second electric signal in a controlled manner.

The variable-directivity MEMS microphone of the present invention comprises a substrate and a cover covering the substrate, wherein the substrate and the cover forms the acoustic cavity.

In the variable-directivity MEMS microphone of the present invention, the first acoustic transducer, the first pre-amplifier, the second acoustic transducer, the second pre-amplifier and the signal processing chip are arranged on the substrate, and the substrate is provided with a first acoustic through-hole and a second acoustic through-hole.

In the variable-directivity MEMS microphone of the present invention, the first acoustic transducer and the first pre-amplifier are provided on the cover, the second acoustic transducer and the second pre-amplifier are provided on the substrate, the signal processing chip is optionally provided on the substrate or the cover, and an acoustic through-hole is formed in the substrate and the cover, respectively.

In the variable-directivity MEMS microphone of the present invention, the directional output signal is an omnidirectional output signal or a splayed directional output signal or a cardioid directional output signal.

The invention further provides an electronic device comprising the variable-directivity MEMS microphone as described above, wherein the electronic device is provided with a control switch for providing the switching control signal.

In the electronic device, the control switch comprises an omnidirectional selector switch, a splayed selector switch, and a cardioid selector switch.

By adopting the above-mentioned technical solutions, the present invention has the beneficial effects that a variable-directivity MEMS microphone is provided in the present invention, a directional output signal is generated by processing of electric signals by a signal processing chip. In this way, a microphone can switchablely provide an output signal with different directivities, so that the volume of a whole structure can be decreased, and reliability can be improved.

BRIEF DESCRIPTION OF THE DRAWINGS

The accompanying drawings, together with the specification, illustrate exemplary embodiments of the present disclosure, and, together with the description, serve to explain the principles of the present invention.

DETAILED DESCRIPTION

The technical solution set forth in the embodiments of the present invention will now be described clearly and fully hereinafter with reference to the accompanying drawings of the embodiments of the present invention. Obviously, such embodiments provided in the present invention are only part of the embodiments instead of all embodiments. It should be understood that all the other embodiments obtained from the embodiments set forth in the present invention by one skilled in the art without any creative work fall within the scope of the present invention.

Notably, the embodiments set forth in the present invention and features of the embodiments may be combined in any suitable manner.

The present invention will be described hereinafter with reference to the accompanying drawings and particular embodiments, but the invention is not limited thereto.

Figure 1:
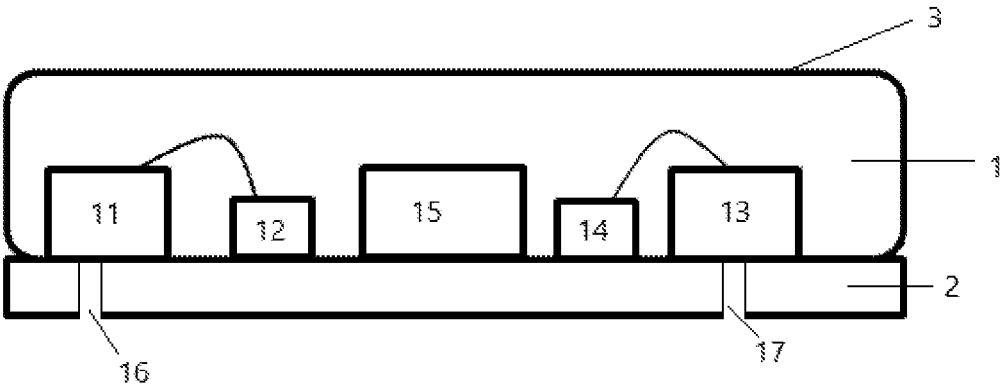
FIG. 1 is a schematic diagram illustrating a structure of a variable-directivity MEMS microphone according to the present invention.

With reference to FIG. 1, a variable-directivity MEMS microphone, comprising an acoustic cavity 1, wherein the following components are provided inside the acoustic cavity 1:

a first acoustic transducer 11 for detecting an acoustic signal and converting the acoustic signal into a first acoustic conversion signal;

a first pre-amplifier 12, connected to the first acoustic transducer 11, and configured for outputting a first electric signal;

a second acoustic transducer 13 for detecting an acoustic signal and converting the detection acoustic signal into a second acoustic conversion signal;

a second pre-amplifier 14, connected to the second acoustic transducer 13, and configured for outputting a second electric signal; and a signal processing chip 15, connected to the first pre-amplifier 12 and the second pre-amplifier 14, and configured for generating a directional output signal by performing an arithmetic operation on the first electric signal and the second electric signal under the action of a switching control signal.

The variable-directivity MEMS microphone provided in the present invention generates the directional output signal by processing the electric signals through the signal processing chip. Of note, in the prior art, a directional microphone is arranged to generate the directional output signal. After comparison of those two types of working principles, the microphone provided in the present invention is capable of providing an output signal with different directivities, so that the volume of a whole structure can be decreased, and reliability can be improved.

Figure 2:
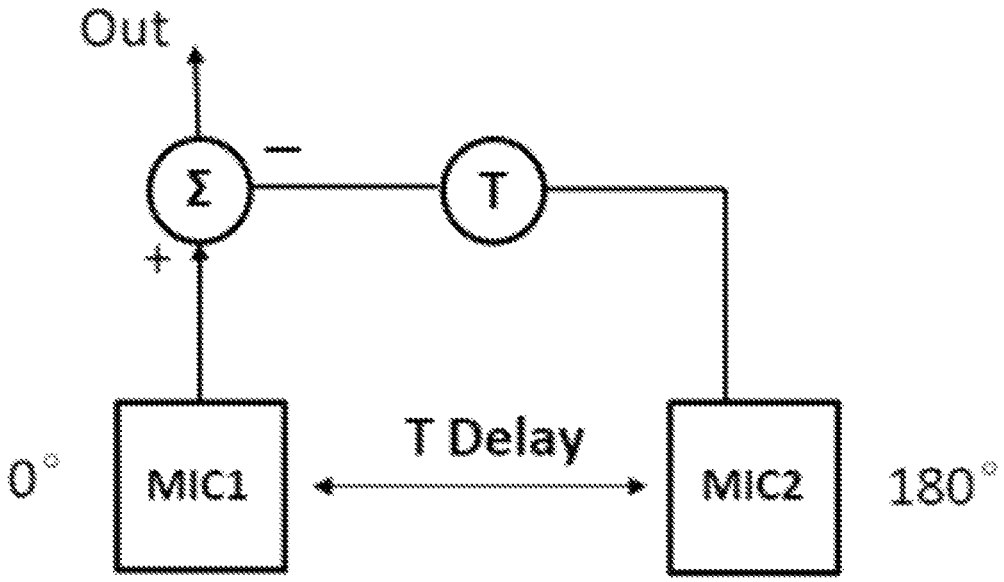
FIG. 2 is a block diagram illustrating a principle of a signal processing chip according to a particular embodiment of the present invention.

In the variable-directivity MEMS microphone of the present invention, wherein the signal processing chip 15 comprises:

a phase delayer T, an output end of which is connected to the second electric signal MIC2, and the second electric signal MIC2 is delayed by a predetermined phase based on the control signal, then a phase-delayed second electric signal is output;

an adder-subtractor Σ for outputting the directional output signal OUT after performing addition and subtraction operations on the first electric signal MIC1 and the phase-delayed second electric signal, as shown in FIG. 2.

Figure 3:
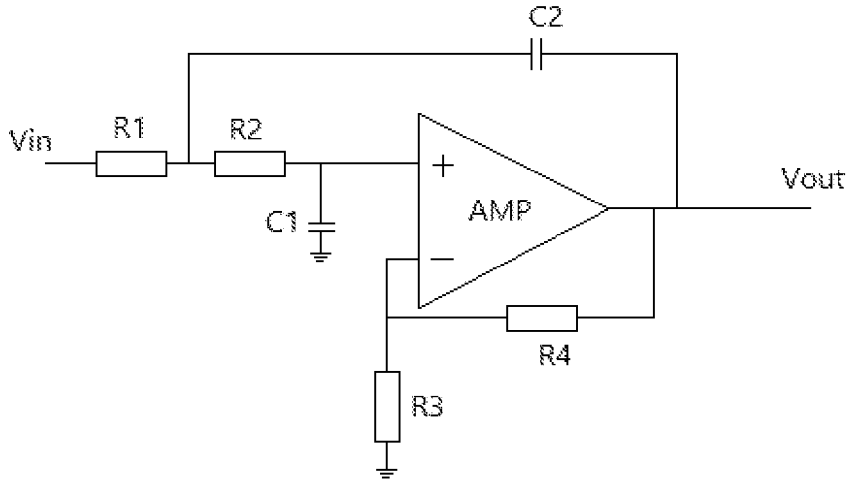
FIG. 3 is a diagram illustrating a principle of a circuit of a phase delayer according to a particular embodiment of the present invention.

In the variable-directivity MEMS microphone of the present invention, as shown in FIG. 3, the phase delayer T comprises:

an operational amplifier AMP having a non-inverting input terminal + and an inverting input terminal −, an output terminal Vout of the operational amplifier outputs the phase-delayed second electric signal;

a first resistor R1 and a second resistor R2 connected in series between the input end of the phase delayer T and the non-inverting input terminal +;

a first capacitor C1 connected between the non-inverting input terminal + and the ground;

a second capacitor C2, wherein one end of the second capacitor C2 is connected at a joint where the first resistor R1 and the second resistor R2 are connected, the other end of the second capacitor C2 is connected to the output terminal Vout of the operational amplifier;

a third resistor R3 connected between the inverting input terminal − and the ground;

a fourth resistor R4 connected between the inverting input terminal − and the output end Vout.

The phase delayer T can achieve a delay of a predetermined phase, and the resistors are regulating resistors.

Figure 5A:
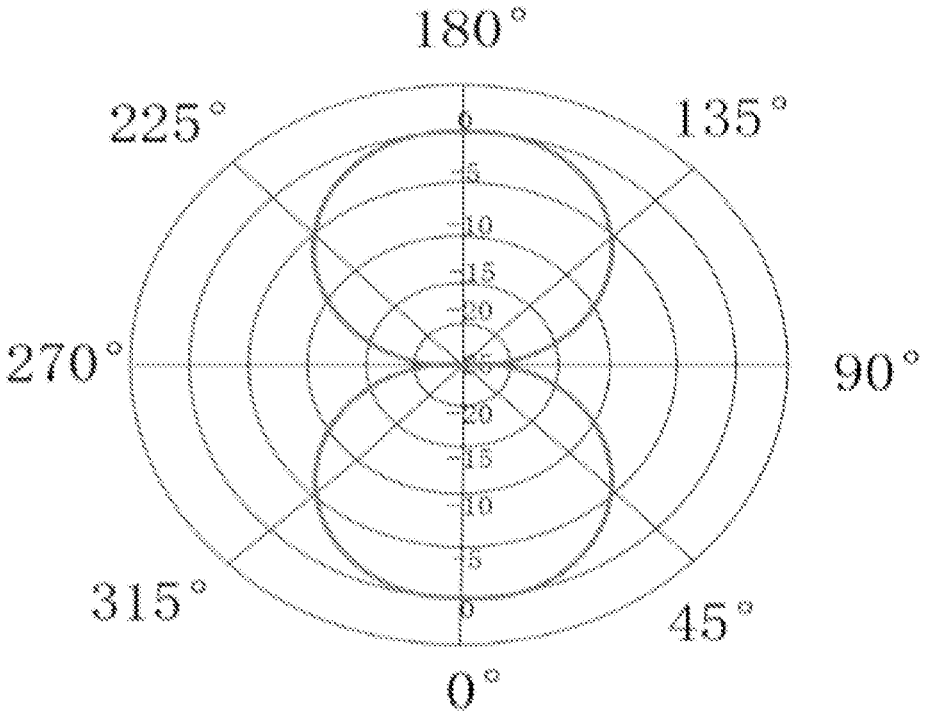
FIG. 5*a* is a schematic diagram of a splayed directivity.
Figure 5B:
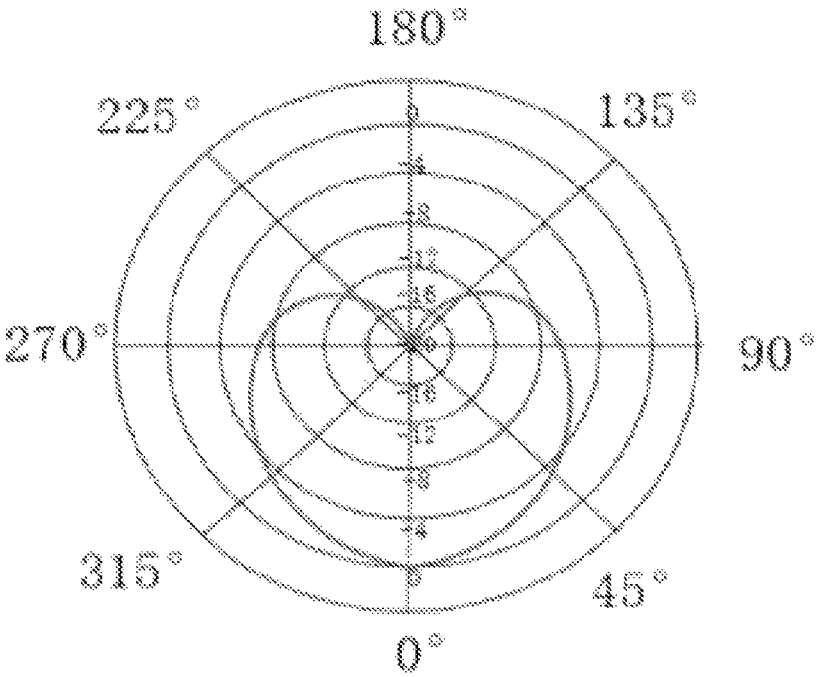
FIG. 5*b* is a schematic diagram of a cardioid directivity.

In the variable-directivity MEMS microphone of the present invention, the adder-subtractor Σ performs an addition operation or a subtraction operation on the first electric signal or the phase-delayed second electric signal in a controlled manner. The adder-subtractor Σ may select to directly output the first electric signal MIC1 as an omnidirectional output signal, or it may select to perform addition operation and subtraction operations on the first electric signal MIC1 or the phase-delayed second electric signal MIC2 to obtain a splayed directional output signal shown in FIG. 5*a*, or to obtain a cardioid directional output signal shown in FIG. 5*b*.

Figure 4:
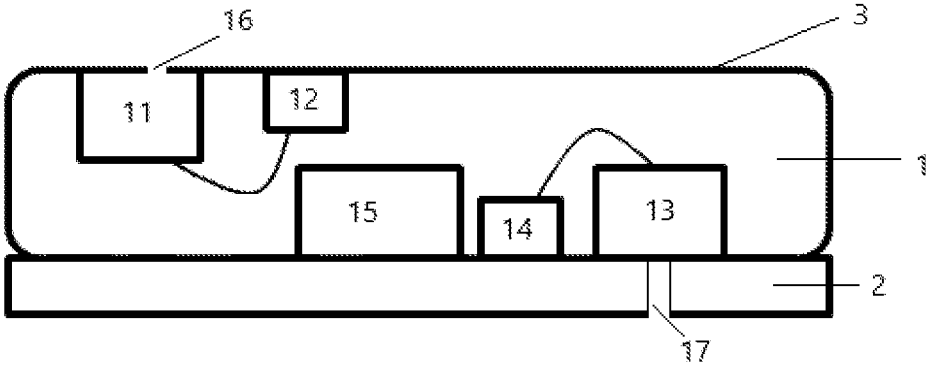
FIG. 4 is a schematic diagram illustrating another structure of a variable-directivity MEMS microphone according to the present invention.

The variable-directivity MEMS microphone of the present invention comprises a substrate 1 and a cover 3 covering the substrate 2, wherein the substrate 2 and the cover 3 form the acoustic cavity 1, as shown in FIGS. 1 and 4.

In the variable-directivity MEMS microphone of the present invention, a particular embodiment is shown in FIG. 1, wherein, the first acoustic transducer 11, the first pre-amplifier 12, the second acoustic transducer 13, the second pre-amplifier 14 and the signal processing chip 15 are arranged on the substrate 2, and the substrate 2 is provided with a first acoustic through-hole 16 and a second acoustic through-hole 17.

In another particular embodiment, as shown in FIG. 4, the first acoustic transducer 11 and the first pre-amplifier 12 are provided on the cover 3, the second acoustic transducer 13 and the second pre-amplifier 14 are provided on the substrate 2, the signal processing chip 15 is optionally provided on the substrate 2 or the cover 3, and acoustic through-holes 16, 17 are formed in the substrate 2 and the cover 3, respectively.

A variable-directivity MEMS microphone is provided in the present invention, a directional output signal is generated by processing of electric signals by a signal processing chip.

In this way, a microphone can switchablely provide an output signal with different directivities, so that the volume of a whole structure can be decreased, and reliability can be improved.

The invention further provides an electronic device comprising the variable-directivity MEMS microphone as described above, wherein the electronic device is provided with a control switch for switching the control signal.

In the electronic device, the control switch comprises an omnidirectional selector switch, a splayed selector switch, and a cardioid selector switch.

The electronic device according to the present invention uses the above-mentioned variable-directivity MEMS microphone. In this way, one microphone is sufficient for switchablely outputting output signals with different directivities. It eliminates the need for an electronic device to arrange a plurality of microphones thereon, so that costs and its volume are substantially reduced.

Exemplary embodiments of specific structures for implementations are illustrated with reference to the description and the accompanying drawings. Other conversions can be made based on the spirits of the invention. The above descriptions are only the preferred embodiments of the invention, not thus limiting the embodiments and scope of the invention.

For those skilled in the art, all variations and modifications are obvious from the above description. Thus, the appended claims are to be construed as all the variations and modifications covering all the true intentions and scope of the invention. Any and all the equivalent scope and contents fall within the spirit and scope of the invention.

What is claimed is:

1. A variable-directivity MEMS (Micro-Electro-Mechanical system) microphone, comprising an acoustic cavity, wherein the following components are provided inside the acoustic cavity:

a first acoustic transducer for detecting an acoustic signal and converting the acoustic signal into a first acoustic conversion signal;

a first pre-amplifier, connected to the first acoustic transducer, and configured for outputting a first electric signal;

a second acoustic transducer for detecting a second acoustic signal and converting the detected second acoustic signal into a second acoustic conversion signal;

a second pre-amplifier, connected to the second acoustic transducer, and configured for outputting a second electric signal; and a signal processing chip, connected to the first pre-amplifier and the second pre-amplifier, and configured for generating a directional output signal by performing an arithmetic operation on the first electric signal and the second electric signal under the action of a switching control signal;

the signal processing chip comprises:

a phase delayer, an output end of which is connected to the second electric signal, and the second electric signal is delayed by a predetermined phase based on the control signal, then a phase-delayed second electric signal is output;

an adder-subtractor for outputting the directional output signal after performing addition and subtraction operations on the first electric signal and the phase-delayed second electric signal;

wherein the phase delayer comprises:

an operational amplifier having a non-inverting input terminal and an inverting input terminal, an output terminal of the operational amplifier outputs the phase-delayed second electric signal;

a first resistor and a second resistor, connected in series between the input end of the phase delayer and the non-inverting input terminal;

a first capacitor, connected between the non-inverting input terminal and the ground;

a second capacitor, wherein one end of the second capacitor is connected at a joint where the first resistor and the second resistor are connected, the other end of the second capacitor is connected to the output terminal of the operational amplifier;

a third resistor, connected between the inverting input terminal and the ground;

a fourth resistor, connected between the inverting input terminal and the output end.

2. The variable-directivity MEMS microphone of claim 1, wherein the adder-subtractor performs an addition operation or a subtraction operation on the first electric signal or the phase-delayed second electric signal in a controlled manner.

3. The variable-directivity MEMS microphone of claim 1, comprising a substrate and a cover covering the substrate, wherein the substrate and the cover forms the acoustic cavity.

4. The variable-directivity MEMS microphone of claim 3, wherein the first acoustic transducer, the first pre-amplifier, the second acoustic transducer, the second pre-amplifier and the signal processing chip are arranged on the substrate, and the substrate is provided with a first acoustic through-hole and a second acoustic through-hole.

5. The variable-directivity MEMS microphone of claim 3, wherein the first acoustic transducer and the first pre-amplifier are provided on the cover, the second acoustic transducer and the second pre-amplifier are provided on the substrate, the signal processing chip is optionally provided on the substrate or the cover, and an acoustic through-hole is formed in the substrate and the cover, respectively.

6. The variable-directivity MEMS microphone of claim 1, wherein the directional output signal is an omnidirectional output signal or a splayed directional output signal or a cardioid directional output signal.

7. An electronic device comprising the variable-directivity MEMS microphone of claim 1, wherein the electronic device is provided with a control switch for providing the switching control signal.

8. The electronic device of claim 7, wherein the control switch comprises an omnidirectional selector switch, a splayed selector switch, and a cardioid selector switch.

* * * * *